US006880616B1

(12) United States Patent
Kemna et al.

(10) Patent No.: US 6,880,616 B1
(45) Date of Patent: Apr. 19, 2005

(54) METHOD AND DEVICE FOR MAKING A METAL STRAND

(75) Inventors: Andreas Kemna, Erlangen (DE); Albrecht Sieber, Möhrendorf (DE); Uwe Stürmer, Baiersdorf (DE); Hans-Herbert Welker, Herzogenaurach (DE)

(73) Assignee: Siemens Aktiengesellschaft, Munchen/Rein (DE)

( * ) Notice: Subject to any disclaimer, the term of this patent is extended or adjusted under 35 U.S.C. 154(b) by 157 days.

(21) Appl. No.: 10/030,340

(22) PCT Filed: Jun. 29, 2000

(86) PCT No.: PCT/DE00/02117

§ 371 (c)(1),
(2), (4) Date: Aug. 27, 2002

(87) PCT Pub. No.: WO01/03867

PCT Pub. Date: Jan. 18, 2001

(30) Foreign Application Priority Data

Jul. 7, 1999 (DE) ..... 199 31 331

(51) Int. Cl.[7] ..... B22D 11/22
(52) U.S. Cl. ..... 164/455; 164/486
(58) Field of Search ..... 164/455, 486, 164/414, 444, 154.1

(56) References Cited

U.S. PATENT DOCUMENTS 5,488,987 A * 2/1996 Di Giusto et al. ..... 164/452
5,734,329 A 3/1998 Khosrowpour et al. 340/825.21
5,974,056 A 10/1999 Wilson et al. ..... 370/509
5,988,259 A * 11/1999 Welker et al. ..... 164/455

FOREIGN PATENT DOCUMENTS

| | | |
|---|---|---|
| DE | 2444443 | 3/1975 |
| DE | 3818077 | 5/1988 |
| DE | 4417808 | 5/1994 |
| DE | 19508476 | 3/1995 |
| DE | 19612420 | 3/1996 |

OTHER PUBLICATIONS

"Standard Field Bus Networks for Industrial Applications" by Cena et al.; *Computer Standards & Interfaces*, Jan. 15, 1995, pp. 155–167.

Harste, K., et al., "Neubau einer Vertikalstranggießanlage bei der AG der Dillinger Hüttenwerke," Stahl U. Eisen, vol. 117, pp. 73–79, 153.

* cited by examiner

*Primary Examiner*—Kiley S. Stoner
*Assistant Examiner*—I.-H. Lin
(74) *Attorney, Agent, or Firm*—Baker Botts LLP

(57) ABSTRACT

A method and device for producing a strand of metal by means of a continuous-casting installation which has at least one cooling device for cooling the strand, the cooling device being assigned at least one reduction stand for reducing the thickness of the strand, the strand, during the thickness reduction, having a solidified skin and a liquid core. The cooling is set, by means of a temperature and solidification model, in such a manner that the solidification boundary between the solidified skin and the liquid core when the strand enters the reduction stand corresponds to a predetermined set solidification boundary between the solidified skin and the liquid core.

8 Claims, 2 Drawing Sheets

METHOD AND DEVICE FOR MAKING A METAL STRAND

CROSS-REFERENCE TO RELATED APPLICATION

This application is a 371 of PCT/DE00/02117 filed on Jun. 29, 2000.

FIELD OF INVENTION

The invention relates to a method and a device for producing a strand of metal by means of a continuous-casting installation which has at least one cooling device for cooling the strand, the cooling device being assigned at least one reduction stand for reducing the thickness of the strand, which during the thickness reduction has a solidified skin and a liquid core.

In the production of strands of metal it is known for a reduction stand to be assigned (downstream) to a continuous-casting installation. A particularly substantial reduction in thickness is achieved if the strand has a core which is still liquid when it enters the reduction stand. In this method, which is known as soft reduction, it is important for the liquid core to be large enough to ensure the required reduction in thickness of the strand while also not being so large that the strand breaks open and the liquid metal escapes. To achieve the required size of the liquid core on reaching the reduction stand, the strand is cooled by means of a cooling device, the cooling required being set by an operator after he has estimated the size of the liquid core. The document "Neubau einer VertikalstranggieBanlage bei der AG der Dillinger Hüttenwerke"[Construction of a new vertical continuous-casting installation at Dillinger H üttenwerke AG]" Stahl and Eisen 117, No. 11; 10 Nov. 1997, demonstrates the problems of the location and positioning of the blunt tip of a strand in relation to the soft reduction zone, and it is taught that the soft reduction zone should be tracked beyond the respective position of the blunt tip during casting. This is possible through the fact that the segments can be hydraulically positioned in the strand-guiding section.

SUMMARY OF INVENTION

It is an object of the present invention to provide a method and a device for carrying out the method which allows soft reduction which is an improvement over the prior art, particularly when the strand velocity varies. This object is achieved by producing a strand made from metal by means of a continuous-casting installation which has at least one cooling device for cooling the strand, at least one reduction stand for reducing the thickness of the strand arranged downstream of the cooling device. During the reduction in thickness, the strand has a solidified skin and a liquid core, and the cooling is set, by means of a temperature and solidification model, in particular automatically, in such a manner that the solidification boundary between the solidified skin and the liquid core when the strand enters the reduction stand corresponds to a predetermined set solidification boundary between the solidified skin and the liquid core. In this way, particularly good soft reduction is achieved. Reduction stands used in the context of the present invention, may, in addition to simple rolling stands, be complex rolling stands, which impart a defined geometry to the strand by rolling. The temperature and solidification model, for example, may be an analytical model, a neural network, or a combination of an analytical model and a neural network. The temperature and solidification model relates the cooling of the strand to the solidification boundary between the solidified skin and the liquid core. Such a configuration of the invention is particularly advantageous since the temperature and solidification model simulates the solidification boundary between the solidified skin and the liquid core as a function of the amount of cooling, using the cause-effect relationship between cooling and the solidification boundary between the solidified skin and the liquid core.

In a preferred embodiment of the present invention, the temperature and solidification model is used to determine the solidification boundary between the solidified skin and the liquid core as a function of the cooling of the strand, in particular in real time and continuously. The required cooling of the strand is determined iteratively as a function of the predetermined set solidification boundary between the solidified skin and the liquid core. Iteration is repeated until the deviation in the solidification boundary between the solidified skin and the liquid core (which has been determined using the temperature and solidification model), from the predetermined set solidification boundary between the solidified skin and the liquid core is less than a predetermined tolerance value.

In another preferred embodiment of the present invention, at least one further variable, selected from the group consisting of strand velocity, strand geometry, strand shell thickness, mold length, time, strand material, coolant pressure or volume, droplet size of the coolant, and coolant temperature is used to determine the required cooling of the strand as a function of the predetermined set solidification boundary between the solidified skin and the liquid core.

In a further preferred embodiment of the present invention, the strand geometry, strand shell thickness, time, strand material, coolant pressure or volume and coolant temperature variables are also used to determine the required cooling of the strand as a function of the solidification boundary between the solidified skin and the liquid core. The use of these variables is particularly suitable for achieving a precise cooling of the strand.

In yet another preferred embodiment, each reduction device is assigned a set solidification boundary between the solidified skin and the liquid core of the strand.

In another preferred embodiment of the invention, the action of the reduction in thickness produced by the reduction stand, in particular the position of the solidification boundary between solidified skin and liquid core, is also modeled in the temperature and solidification model.

In a further preferred embodiment of the invention, the modeling of the reduction in thickness produced by the reduction stand is carried out using at least one of the variables reduction force and degree of reduction.

In a further preferred embodiment of the invention, at least one of the variables reduction force and degree of reduction is measured in the reduction stand and, is used to adapt the temperature and solidification model.

BRIEF DESCRIPTION OF THE DRAWINGS

Further advantages and details of the present invention are described below with reference to the drawings in which.

DETAILED DESCRIPTION OF THE INVENTION

Figure 1:
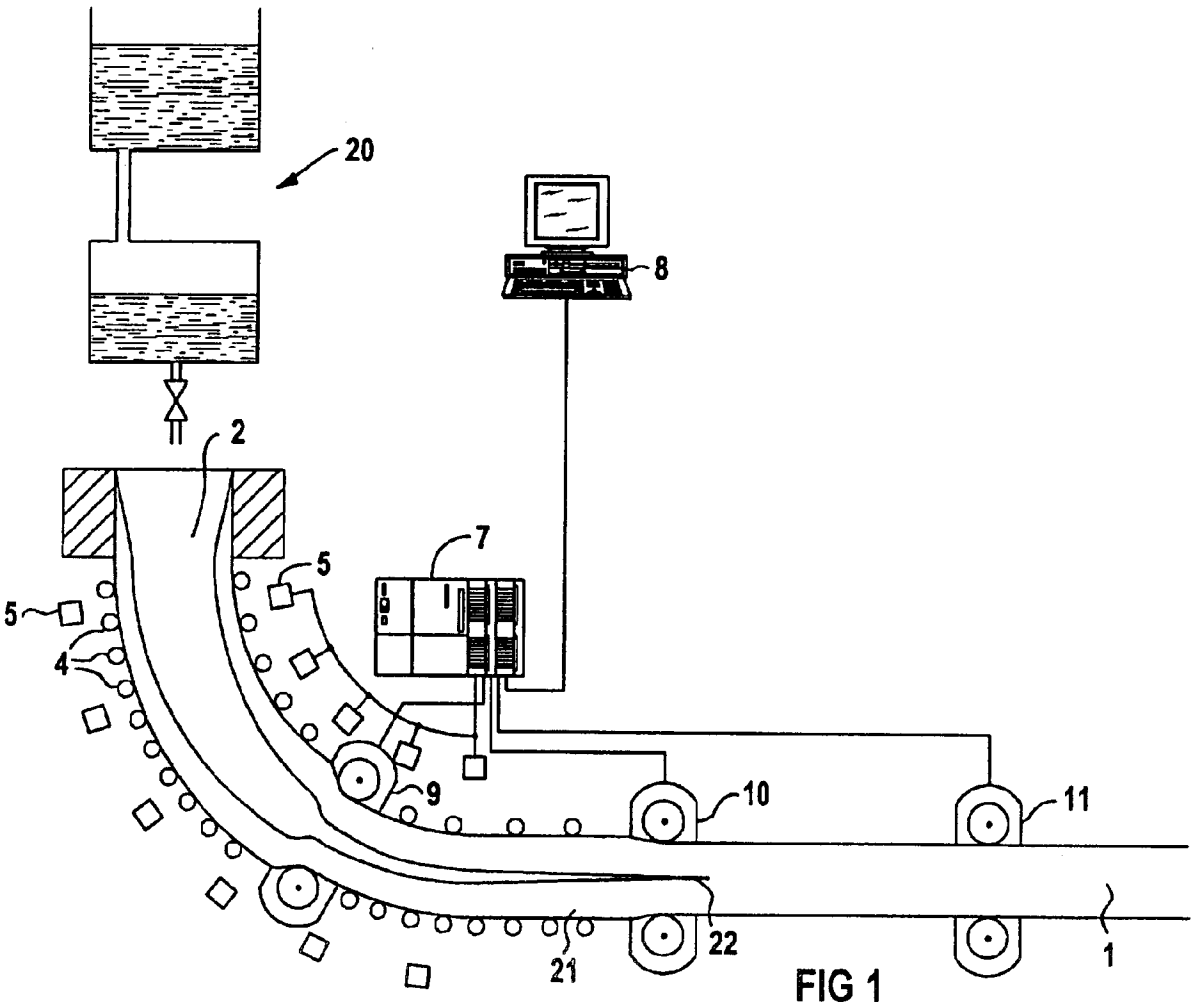
FIG. 1 illustrates a continuous-casting installation.

FIG. 1 shows a continuous-casting installation. Reference numeral 1 denotes the cast strand, which has a solidified skin 21 inside a solidification boundary 22 and a liquid core 2. The strand is moved using drive and guide rolls 4 and is cooled as it passes through cooling devices 5, which are preferably designed as water-spraying devices. For the sake of simplicity, not all the drive and guide rolls 4 and cooling devices 5 are provided with reference numerals. In known methods, the cooling devices 5 are divided into cooling segments. This division is not necessary in the method of the present invention, but can nevertheless be included. Both the drive rolls 4 and the cooling devices 5 are connected in terms of data technology to a computing device. In the present exemplary embodiment, bugs are connected in terms of data technology to the same automation unit 7. The automation unit 7 optionally also has a terminal (not shown) and a keyboard (not shown). In addition, the automation unit 7 is connected to a higher-level computer system 8. The material required for continuous casting, in this case liquid steel, is supplied via a feed apparatus 20. The control variables for the cooling devices 5 are calculated by means of a temperature and solidification model, i.e. a thermal model of the strand which is implemented on the higher-level computer system 8.

Reference numerals 9, 10 and 11 denote reduction stands assigned to the cooling device 5. In a preferred embodiment of the invention these stands are connected in terms of data technology to the programmable-memory control unit 7. The rolling force and the degree of reduction, for example in the form of the roll nip, is transmitted to the automation unit 7. FIG. 1 illustrates three reduction stands 9, 10 and 11. In the exemplary embodiment, only a soft reduction is carried out in the reduction stands 9 and 10. In soft reduction, the strand which is to be reduced is not fully solidified, but rather has a liquid core 2 and a solidified skin 21 when it enters a reduction stand. As shown in FIG. 1, only soft reduction for the strand 1 is provided in the reduction stands 9 and 10. Using the devices 5 the cooling is set by means of the automation unit 7 in such a manner that the solidification boundary 22 between the solidified skin 21 and the liquid core 2 of the strand 1 when it enters the reduction stands 9 and 10 corresponds to a desired set solidification boundary between the liquid core 2 and the solidified skin 21.

It is preferred for the reduction stand 9 to be arranged inside the cooling section, i.e. cooling devices 5 are provided upstream and downstream of the reduction stand 9. Furthermore, it is preferable for the cooling devices to be provided downstream of the second reduction stand 10. The cooling device 9 is preferably not arranged over the bending of the strand 1, as indicated in FIG. 1, but rather is arranged upstream of the bending of the strand or downstream of the bending of the strand 1.

Figure 2:
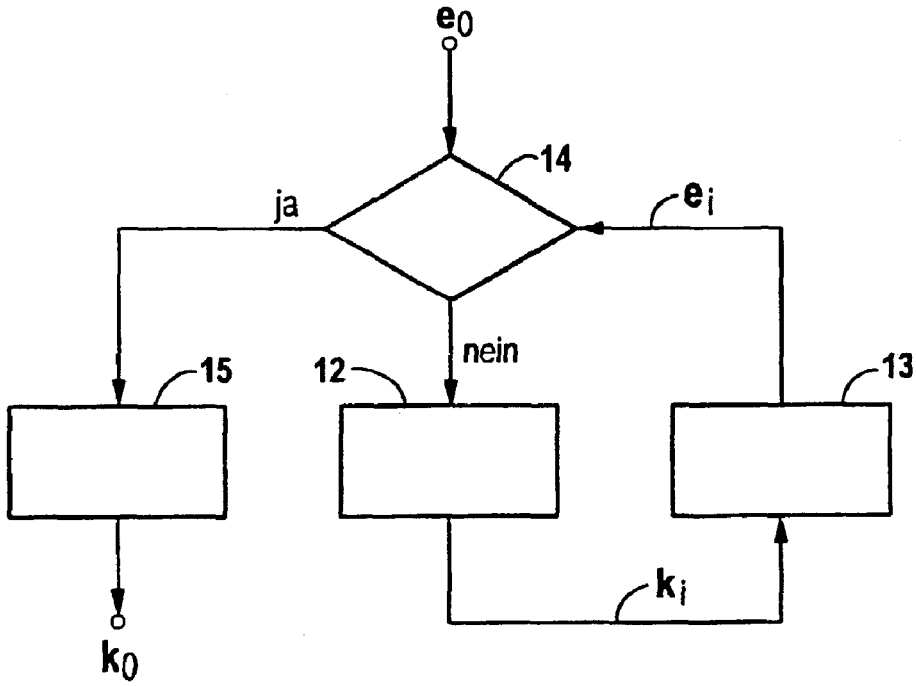
FIG. 2 illustrates a flow diagram for the iterative determination of desired cooling of the strand by means of a temperature and solidification model.

FIG. 2 illustrates a flow diagram for the iterative determination of a set value $k_0$ for the cooling of the strand by means of a temperature and solidification model 13. The temperature and solidification model 13 and the remaining iterative sequences illustrated are implemented on the higher-level computer system 8. In the temperature and solidification model 13 the solidification boundaries $e_i$ in the strand are determined from the given cooling of the strand $k_i$ by means of the temperature and solidification model 13. In a comparison unit 14, this solidification boundary $e_i$ is compared with the set solidification boundary $e_o$ in the strand. The comparison unit 14 interrogates whether $|e_i - e_o| \leqq \Delta e_{max}$, where $\Delta e_{max}$ is a predetermined tolerance value. If the difference between $e_i$ and $e_o$ is too high, the function block 12 determines a new proposal $k_i$ for improved cooling of the strand. A value for the cooling which has proven to be a suitable empirical value on average over a prolonged period is used as the starting value for the iteration. If the difference between $e_i$ and $e_o$ is less than or equal to the tolerance value $\Delta e_{max}$, a set cooling fixing 15 is used to set the value $k_o$ for the cooling of the strand so as to be equal to the value $k_i$. The values $e_i$, $e_o$, $\Delta e_{max}$, $k_i$, $k_o$ are not necessarily scalars, but rather column matrices with one or more values. For example, the column matrix $k_o$ contains the various control and command variables for the cooling devices 5 of the individual cooling segments 6 of a strand-cooling installation, or the column matrix $e_o$ contains the set solidification boundaries at various locations of the strand. In a preferred embodiment, the iteration cycle illustrated in FIG. 2 takes place on the basis of genetic algorithms. This is particularly recommended if $k_i$ and $k_o$ are column matrices containing numerous elements.

The temperature and solidification model 13 can be implemented both as a one-dimensional model and as a two-dimensional model. The heat conduction equation:

$$\frac{\partial T}{\partial t} = a\left(\frac{\partial^2 T}{\partial^2} + \frac{\partial^2 T}{\partial y^2}\right) \tag{1}$$

which for the temperature and solidification model 13 is used in difference form, i.e. in the form $$\Delta_i T - a\Delta T\left(\frac{1}{\Delta x^2}\Delta\frac{2}{x}T + \frac{1}{\Delta y^2}\Delta\frac{2}{y}T\right) \tag{2}$$

forms the basis for the temperature and solidification model, in this case shown as two-dimensional. In these equations, T is the temperature, t is the time and a is the thermal conductivity. The two-dimensional spatial coordinates are x and y.

The cross section of the strand skin is divided into small rectangles $\Delta x$ by $\Delta y$, and the temperature is calculated in small time steps $\Delta t$. The starting point used for the temperature distribution is based on the assumption that the temperature on entry into the mould (in all rectangles) is the same as the tundish temperature of the steel.

The heat flux Q which is to be dissipated at the surface of the strand is calculated from the surface temperature $T_o$ of the strand, the ambient temperature $T_u$, the surface area A and the heat transfer coefficient $\alpha$, where $Q=\alpha(T_u-T_o)$ A. For cooling in the mould, a is assumed to be constant and $t_u$ is deemed to be equal to the temperature of the cooling water in the mould. For cooling by the cooling devices 5, $T_U$ is assumed to be the same as the temperature of the coolant and a is calculated, for example, as:

$$\alpha = \left(200 + 1.82\ V\frac{m^2\min}{1}\right)\frac{w}{m^2K} \tag{3}$$

where V is the coolant volume in $$\frac{1}{m^2\min}\cdot V$$

can be given differently for any point on the strand surface, with the result that the model can also be used to describe nozzle characteristics.

The model also calculates the profile of the solidification boundary from the profile of the temperature distribution in the strand.

The individual modeling parameters (variables) include:

Mould length

Strand geometry (height and width)

Strand velocity

Heat transfer coefficient $\alpha$ in the mould

Coolant temperature in the mould

Melt temperature

Enthalpy of solidification

Thermal conduction coefficient $\lambda$

Specific heat capacity c

Density $\rho$

Length of each cooling zone

Coolant volume V in each cooling zone

Strand material

The temperature and material dependency of $\lambda$, c, enthalpy and $\rho$ is taken into account in the model.

Figure 3:
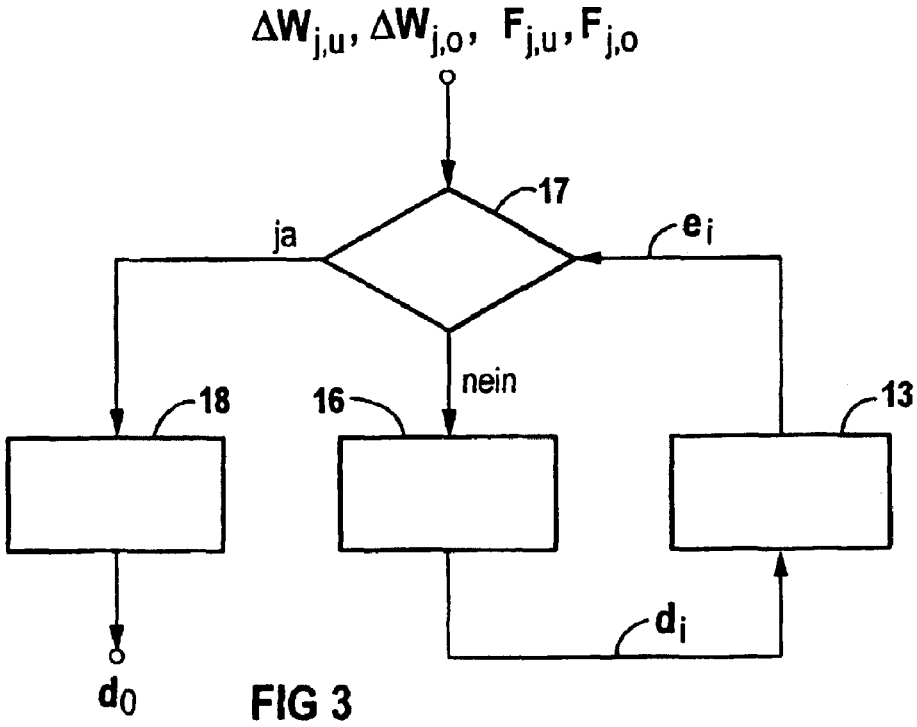
FIG. 3 illustrates a flow diagram for the iterative determination of an adaptation coefficient.

FIG. 3 shows a flow diagram for the iterative determination of an adaptation coefficient $d_o$ for adapting the heat transfer coefficient $\alpha$ by means of a temperature and solidification model 13, the adapted heat transfer coefficient $\alpha_a$ being determined from the heat transfer coefficient $\alpha$ by $$\alpha_a = d_o * \alpha.$$

For this purpose, the solidification boundaries $e_i$ in the strand are determined from given cooling of the strand by means of the temperature and solidification model 13. In a comparison unit 17, this solidification boundary $e_i$ is compared with the roll strokes $\Delta W_{j,y,u}$ (lower) and $\Delta W_{j,y,o}$ (upper), which occur in the reduction stands and the rolling forces $F_{j,u}$ (lower) and $F_{j,o}$ (upper) in the reduction stands. If the values of the roll strokes which are typical for a change in geometry are undershot and/or the values of the rolling forces which are typical for a change in geometry are exceeded, the function block 16 determines a new proposal for an improved adaptation factor $d_i$. As a result, the solidification boundary is shifted until the corresponding limit values are exceeded or undershot, respectively. The starting value used for the iteration is a value $d_o=1$. The end of the iteration is set by the function block 18 $d_o=d_i$. The heat transfer coefficient $\alpha$ in equation 3 is replaced by the adapted heat transfer coefficient $\alpha_a$.

It is preferred if a pilot control is provided for the cooling device, in which case the transmission dependency of known times of the changes of installation values, such as the casting rate and/or the strand material, takes place.

What is claimed is:

1. A method for producing an extrusion casting system comprising a metal strand using at least one cooling device for cooling the strand, the cooling device being associated with at least one reduction stand for reducing the thickness of the strand, the strand, which during the thickness reduction has a solidified skin and a liquid core, wherein the at least one cooling device is arranged ahead of the at least one reduction stand and cooling is adjusted by means of a temperature and solidification model so that a solidification boundary between the solidified skin and the liquid core corresponds to a predetermined set solidification boundary between the solidified skin and the liquid core when the strand enters the reduction stand.

2. The method according to claim 1, further comprising using the temperature and solidification model to determine the solidification boundary between the solidified skin and the liquid core as a function of the cooling of the strand, and determining the required cooling of the strand iteratively as a function of the predetermined set solidification boundary, iteration being repeated until any deviation in the solidification boundary from the predetermined set solidification boundary is less than a predetermined tolerance value.

3. The method according to claim 1, further comprising using at least one variable selected from the group of variables consisting of strand velocity, strand geometry, strand shell thickness, mold length, time, strand material, coolant pressure or volume, droplet size of the coolant and coolant temperature to determine the cooling of the strand as a function of the predetermined set solidification boundary.

4. The method according to claim 3, further comprising using the variables strand geometry, strand shell thickness, time, strand material, coolant pressure and volume, and coolant temperature to determine the cooling of the strand as a function of the solidification boundary.

5. The method according to claim 3, wherein modeling of the reduction in thickness produced by the reduction stand is carried out using at least one of the variables reduction force and degree of reduction in thickness.

6. The method according to claim 3, wherein at least one of the variables reduction force and degree of reduction is measured in the reduction stand and is used to adapt the temperature and solidification model.

7. The method according to claim 1, further comprising arranging at least two reduction stands downstream of the cooling device, and wherein the said at least two reduction stands are assigned a set solidification boundary between the solidified skin and the liquid core of the strand when it enters a reduction stand.

8. The method according to claim 1, further comprising taking into account the position of the solidification boundary between solidified skin and liquid core in the temperature and solidification model.

* * * * *